United States Patent [19]

Warncke et al.

[11] 4,187,843

[45] Feb. 12, 1980

[54] RESPIRATOR HAVING AN OXYGEN-RELEASING CHEMICAL CARTRIDGE AND MEANS FOR ATTACHING AN ADDITIONAL CARTRIDGE

[75] Inventors: Ernst Warncke, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 870,635

[22] Filed: Jan. 19, 1978

[30] Foreign Application Priority Data

Jan. 24, 1977 [DE] Fed. Rep. of Germany ..... 2702673

[51] Int. Cl.[2] ..... A62B 7/08

[52] U.S. Cl. ..... 128/202.26

[58] Field of Search ..... 128/191 R, 142 R, 142.2, 128/142.4, 142.6, 142.7, 146.6, 147, 202, 188, 142.3, 142.5, 140 R, 203; 55/312, 418, DIG. 33, DIG. 35, 482, 286, 387

[56] References Cited

U.S. PATENT DOCUMENTS

| | | | |
|---|---|---|---|
| 2,354,452 | 7/1944 | Foregger | 128/202 |
| 3,980,081 | 9/1976 | Cotabish et al. | 128/147 |

FOREIGN PATENT DOCUMENTS

| | | | |
|---|---|---|---|
| 208565 | 4/1909 | Fed. Rep. of Germany | 128/191 R |

*Primary Examiner*—Henry J. Recla

*Attorney, Agent, or Firm*—McGlew and Tuttle

[57] ABSTRACT

A respirator comprises an air hose which has a mouthpiece which is adapted to be connected to the patient and an opposite end which is connected into a first cartridge housing which has an oxygen-liberating chemical therein. The first cartridge housing has a tubular inlet member connected between the air hose and the housing which has a through-flow air passage from the air hose into the housing, and has a second cartridge receiving opening intermediate the air passage. The first cartridge housing has a bottom wall which is spaced from the chemical therein and which has a connection at one end for connecting an air bag which is arranged around the cartridge. The opposite end of the bottom wall has a second cartridge receiving opening. The second cartridge housing has one end with a laterally extending tubular connection piece which defines an air flow passage which is insertable into the first receiving opening of the first housing in a manner such that it blocks the flow passage. The flow is instead diverted through an opening in the tubular connection into the second housing past an auxiliary oxygen-liberating chemical arranged in the second housing. In addition, coupling means are provided for effecting a coupling between the second receiving opening of the first cartridge and an air space defined at the bottom of the second cartridge below the oxygen-liberating chemical.

4 Claims, 3 Drawing Figures

RESPIRATOR HAVING AN OXYGEN-RELEASING CHEMICAL CARTRIDGE AND MEANS FOR ATTACHING AN ADDITIONAL CARTRIDGE

FIELD AND BACKGROUND OF THE INVENTION

This invention relates to respirators in general and, in particular, to a new and useful respirator with an oxygen-releasing chemical cartridge, including means for coupling an additional cartridge thereto.

DESCRIPTION OF THE PRIOR ART

In respirators with oxygen-releasing chemical cartridges with a solid oxygen-liberating chemical, the oxygen production occurs due to a reaction of the oxygen-containing chemical with the moisture and the carbon dioxide in the exhaled air, or it takes place spontaneously after ignition. With the chemical cartridge present in the apparatus, the time of use is limited, but it can be extended by the coupling-in of an additional, possibly larger, chemical cartridge.

A known oxygen respirator, which can be used with systems having a circulation of the respiratory air, as well as in swinging respiration, is equipped with a cartridge which contains the oxygen-releasing, carbon dioxide-binding material and which can be changed during use of the apparatus. The cartridge is provided in its sheath or housing with an inlet aperture and an opposite outlet aperture. It is mounted gas-tight in a bearing. After it is spent, it can be replaced by a new cartridge inserted directly behind it, which may be inserted during uninterrupted use of the apparatus under a hermetic seal of the coupling apertures.

The bearing may consist of a tubular external container, open at both ends, or it may comprise two opposite bowl-type shells which are secured to a bearing plate. At least one of these is pressed elastically against the sheath of the carriage. In this respirator, the sealing of the cartridges in the long bearing, in which almost two cartridges must be received axially one behind the other, is not easy. With the rough treatment for which these devices are intended, it is bound to happen that an easy sliding-in changing of the cartridges will be prevented by dirt. Moreover, there is no assurance that the cartridge in use will be fully utilized to the end. See German Pat. No. 650,830.

Another known oxygen respirator, functioning with circulation respiratory air, contains a replaceable air purifying cartridge. The carbon dioxide is absorbed in a known manner in the air purifying cartridge, and oxygen is generated. During operation with the air purifying cartridge connected, the respiratory air is conducted through the cartridge and into a breathing bag and is then inhaled again by a direct route. The air purifying cartridge has an air inlet and an air outlet opening arranged concentrically to each other, whereby, it is connected into the respiration system via a sleeve coupling and a valve arrangement consisting of two spring-loaded nested valve shutters. After removal of the cartridge, the sleeve coupling is sealed from the outside, whereas, the passage for exhalation from the wearer to the breathing bag is open. Despite the complicated design of the coupling with the valves, the replacement of the spent cartridges results in a dangerous moment for the wearer. During this time, the user can only breathe from the breathing bag, the respiratory air content of which is exhausted after only a few breaths.

Exchange of the air purifying cartridge must, therefore, be carefully prepared and must then still be installed without difficulties. It is likely that, in emergency situations, problems may arise. See German Pat. No. 1,209,434.

SUMMARY OF THE INVENTION

The present invention extends the time of use of respirators with an oxygen-releasing chemical cartridge by coupling a supplementary chemical cartridge, without jeopardizing the wearer by interruption of the supply of respiratory gas during the coupling thereof.

An advantage achieved with the present invention is that the wearer is not burdened with a great weight during his normal activity, during which he only carries the respirator on his person, but does not use it. To begin its use, the respirator has a small and, therefore, lightweight chemical cartridge, which however provides full breathing protection, if only for a limited time.

To extend the time of use, a larger supplementary chemical cartridge is then coupled to the smaller chemical cartridge, without endangering the wearer's breathing and thus his safety. The supplementary chemical cartridges are stored in places known to the wearer and are readily available there when a catastrophe arises. The technical design of the connection of the supplementary chemical cartridge to the respirator is simple and safe. The necessary two seals are effected without a complicated double fit. The ability to breathe is not interrupted during the coupling process. The supplementary chemical cartridge may be larger, so that the time of use can be made as long as is desired.

By additionally equipping the respirator and the chemical cartridge with check valves, different air conductions are possible, which permit, in an advantageously simple manner, adaptation to the respective need. Among other things, a user, in whose area great differences in altitude must be overcome, may accept equipment rendered somewhat more complicated by valves in order to get to a lower respiration resistance, or in order to be able to inhale air which has been cooled in the breathing bag.

With the invention, the installed chemical cartridge of the respirator is completely bypassed. The wearer need overcome only the respiratory resistance of the supplementary chemical cartridge. In an embodiment with the check valves in the connecting piece and in the uptake, such resistance occurs only during inhalation.

Accordingly, it is an object of the invention to provide a respirator which includes a first cartridge housing containing an oxygen-liberating chemical which is connected to an air hose and also to an air bag and which includes a first receiving opening for receiving a tubular connection of a second or auxiliary cartridge and a coupling connection for coupling the second cartridge in another receiving opening in the first cartridge together and, wherein, the first coupling connection provides a cut-off of the flow through the first cartridge and a diversion of the flow to the second cartridge and through the second cartridge to the air bag.

A further object of the invention is to provide a respirator having an oxygen-releasing chemical cartridge and means for attaching an additional cartridge, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
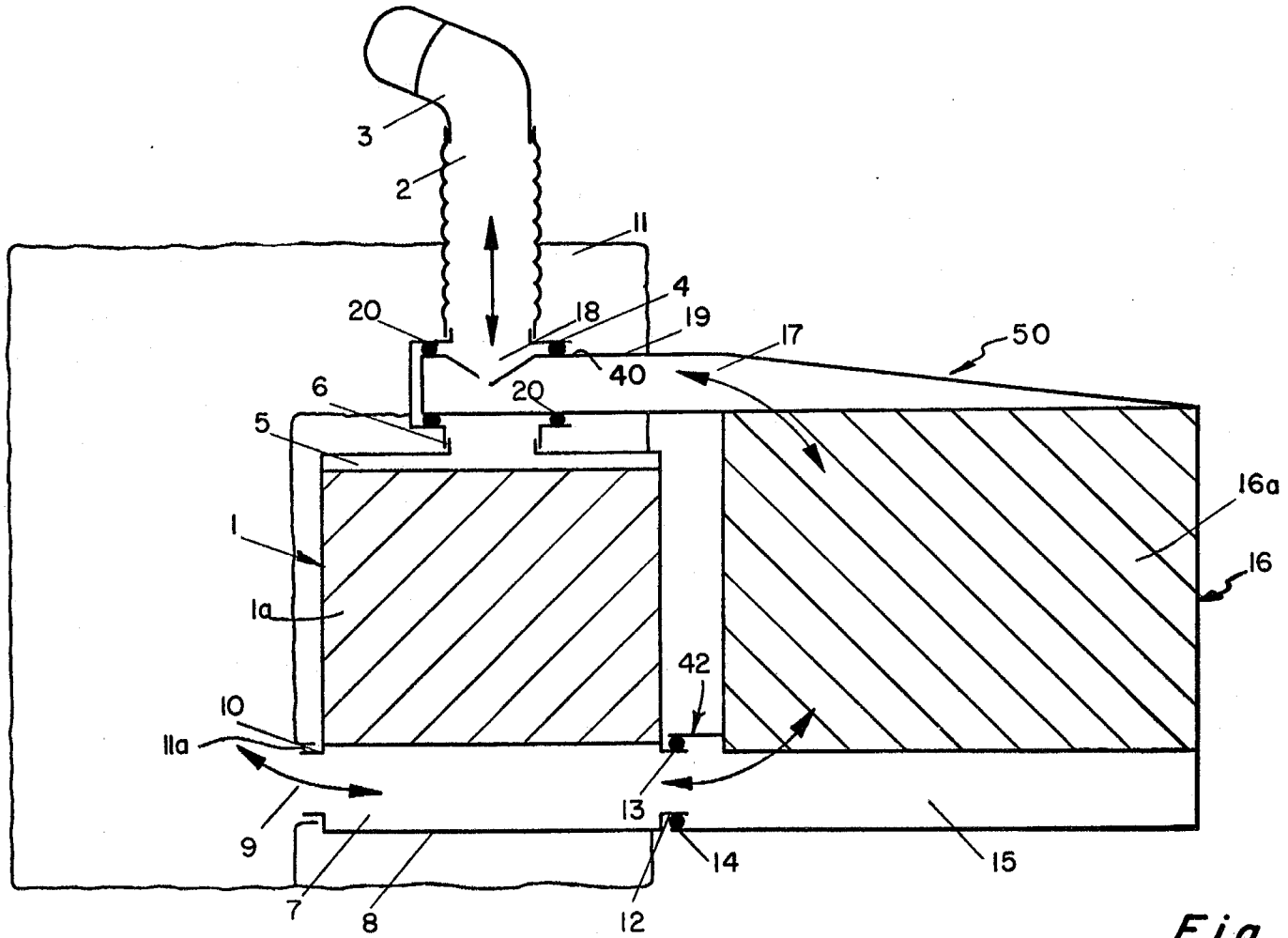
FIG. 1 is a schematic sectional view of a respirator constructed in accordance with the invention.

Referring to the drawings in particular, the invention embodied therein, comprises a respirator, generally designated 50, which includes a first cartridge or housing 1, carrying an oxygen-liberating chemical 1*a* which is connected to a breathing hose 2 which, in turn, has a mouthpiece for connection to a patient (not shown). The first respirator also includes an air bag connection 9 to an air bag 11.

In accordance with the invention, a second cartridge or housing 16 is connectable to the first cartridge by an interengagement of a tubular extension or connection piece 19 into a first receiving opening 40 of a connection piece or breathing connection 4 which has a vertically extending through passage therein for the flow of the respiratory gases which are transverse to the first receiving opening 40. The second housing 16 and first housing 1 are also connected by coupling means, generally designated, for coupling an air space or cavity 15 of the second cartridge 16 to an air space or cavity 7 defined at the bottom of first cartridge 1.

The respirator 50 comprises a housing or cartridge 1 with a carbon dioxide-binding, oxygen-releasing chemical 1*a* which is advantageously of a cylindrical or block form, a breathing hose 2 having a mouthpiece 3 at one end having an opposite end connected to a breathing connection or tubular inlet part 4. The chemical cartridge housing 1 has a cavity 5 above the chemical 1*a* which is connected, via a connecting piece or neck 6, with the breathing connection 4. The cavity 7 below the chemical 1*a* is limited downwardly by a bottom 8 of housing 1. A breathing bag 11 encompasses a part of the housing 1 and it has an opening 11*a* which is connected via the connecting piece 10 to an opening 9 of the cavity 7. A flange or further connecting piece 12 receives a sleeve 14 of a second cartridge housing 16 and is sealed by a seal 13. Sleeve 14 connects the cavity 7 with a cavity 15 below the chemical filling 16*a* of the supplementary chemical cartridge 16. A cavity 17 thereof above the filling 16*a* is connected with the breathing connection 4 through a tubular connecting piece 19 which is introduced into an uptake portion 18 of the breathing connection 4. Sealing of the connecting piece 19 in the uptake 18 is effected through seals or O-rings 20.

Figure 2:
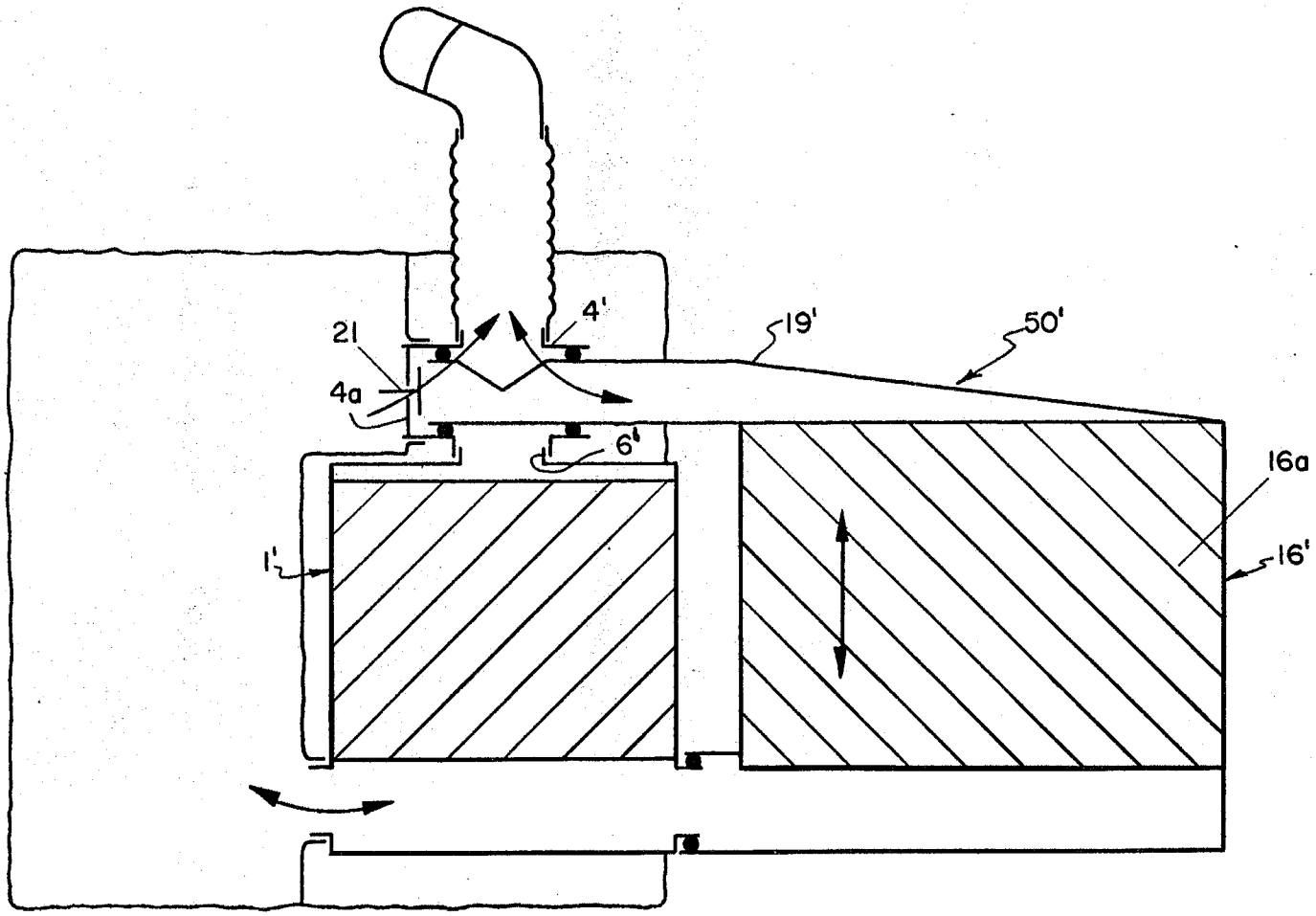
FIG. 2 is a view similar to FIG. 1 of another embodiment of the invention.
Figure 3:
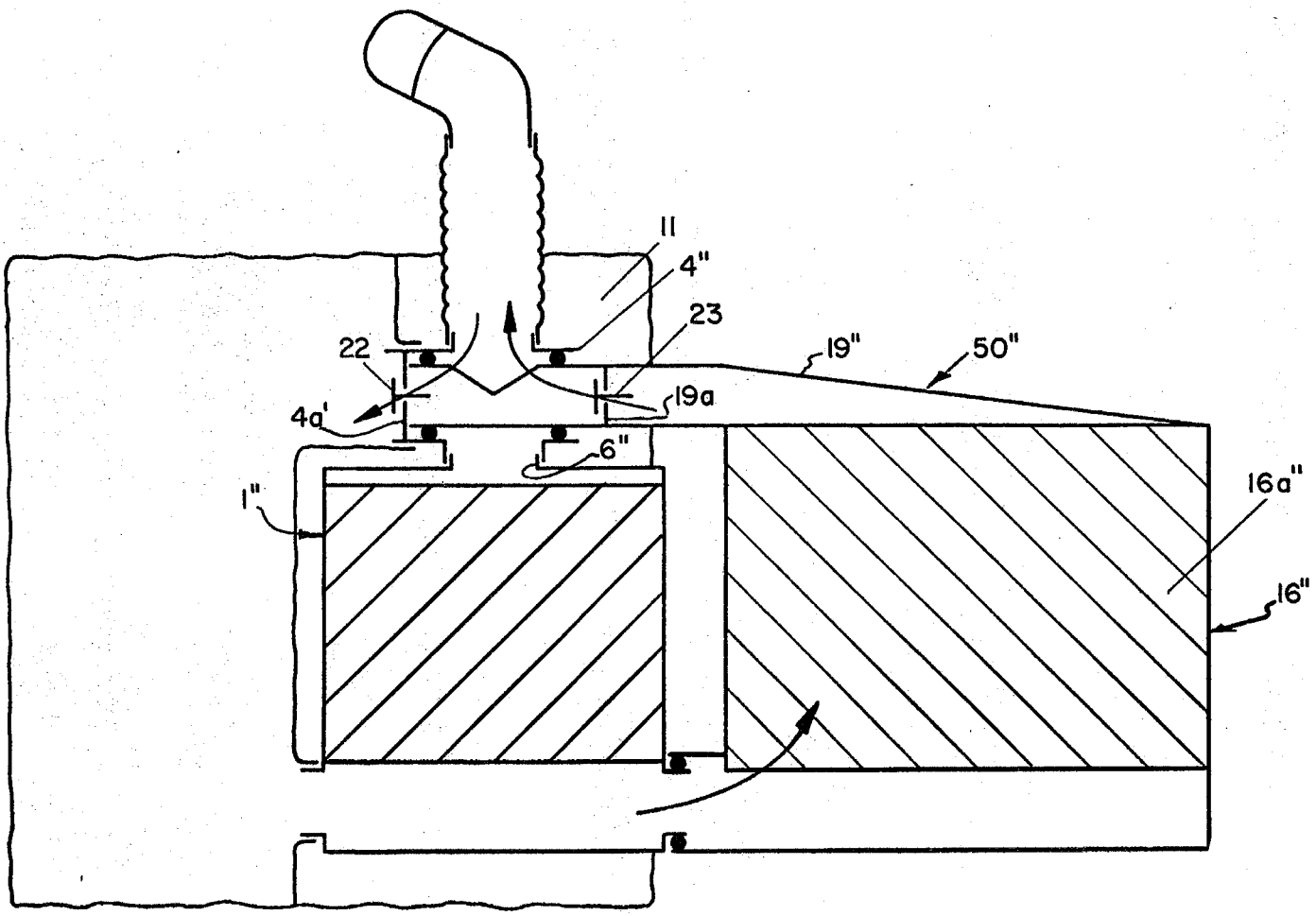
FIG. 3 is a view similar to FIG. 1 of still another embodiment of the invention.

In the embodiments according to FIGS. 1 to 3, the chemical cartridges 1, 1' and 1'' are completely bypassed after the respective supplementary chemical cartridges 16, 16' and 16'' has been coupled. During coupling, the respective connecting pieces 19, 19' and 19'' penetrate into the uptakes 4, 4' and 4'' and completely close off access to the respective connecting piece 6, 6' or 6'' of the chemical cartridge 1.

In the embodiment of FIG. 1, the respirator is used in swinging respiration. This is true of the use for the chemical cartridge 1, as well as with the supplementary chemical cartridge 16.

The embodiment according to FIG. 2 shows the respirator 50' functioning on the principle of circulation. Control is effected through the check valve 21, which opens upon inhalation inwardly in a wall 4*a* of the breathing connection 4'. A small partial stream of inhaled air flows, dependent on the resistance of the supplementary chemical cartridge 16', through the chemical 16*a'* thereof.

In the embodiment according to FIG. 3, exhaled air passes directly out of the breathing connection 4'' through a check valve 22 in a wall 4*a''* and into the breathing bag 11 of a respirator 50''. The inhaled air then flows back via the supplementary chemical cartridge 16 and check valve 23 in a wall 19*a* of connecting piece 19'' into the breathing connection 4''.

While specific embodiments of the invention have been shown and described in detail to illustrate the application of the principles of the invention, it will be understood that the invention may be embodied otherwise without departing from such principles.

What is claimed is:

1. A respirator comprising a respirator air hose having a mouthpiece connection at one end and an opposite end, a first cartridge housing having an oxygen-releasing chemical therein, said housing having a tubular inlet portion connected between and extending transversely to said air hose and said first cartridge housing with a through flow air passage therein from said air hose to said first cartridge housing, said tubular inlet portion having a first receiving opening intermediate the air passage, said first cartridge housing having a bottom wall spaced from the oxygen-releasing chemical with an air bag opening and a second receiving opening spaced from the air bag opening, an air bag adjacent said first cartridge housing connected to said air bag opening, a second cartridge housing having one end with a laterally extending tubular connecting piece defining an air flow passage and being removably inserted into the first receiving opening of said tubular inlet portion and blocking the flow passage therethrough, said tubular connecting piece having an opening disposed in the air flow passage for receiving the air flow from the passage of the air into the interior of said second cartridge housing, said second cartridge housing having an oxygen-releasing chemical therein spaced upwardly from the bottom of said second cartridge housing to define an air space below the chemical, coupling means removably coupling said second cartridge housing to said first cartridge housing when said tubular connecting piece is inserted into the first receiving opening and communicating in the air space below the oxygen-releasing chemical in the second cartridge housing with the space below the oxygen-releasing chemical in said first cartridge housing through said second receiving opening, said respirator being for swinging respiration in which respirator gases are exhaled through said air hose and through the air passage of said tubular inlet portion through the chemical of the first cartridge housing to the space in the first cartridge housing below the chemical and then to the air bag and flows in the reverse direction during inhaling when the second cartridge housing is not connected to said first cartridge housing, and when said second cartridge housing is removably connected to said first cartridge housing, the flow of respiratory gases during exhalation being from the air hose through the tubular connection of said second cartridge housing which blocks the flow passage to said first cartridge housing, and then to the second chemical in the second cartridge housing to the air space in the second cartridge housing below the chemical and through the coupling means to the air space below the chemical in the first cartridge housing and into the air bag and, during exhaling, with the flow being in the reverse direction, said tubular connecting piece of said second cartridge housing having an outer closed end which engages in said tubular inlet portion of said first cartridge housing and a top wall with an opening therethrough disposed in said air flow passage for receiving the air flow therethrough.

2. A respirator comprising a respirator air hose having a mouthpiece connection at one end and an opposite end, a first cartridge housing having an oxygen-releasing chemical therein, said housing having a tubular inlet portion connected between and extending transversely to said air hose and said first cartridge housing with a through flow air passage therein from said air hose to said first cartridge housing, said tubular inlet portion having a first receiving opening intermediate the air passage, said first cartridge housing having a bottom wall spaced from the oxygen-releasing chemical with an air bag opening and a second receiving opening spaced from the air bag opening, an air bag adjacent said first cartridge housing connected to said air bag opening, a second cartridge housing having one end with a laterally extending tubular connecting piece defining an air flow passage and being removably inserted into the first receiving opening of said tubular inlet portion and blocking the flow passage therethrough, said tubular connecting piece having an opening disposed in the air flow passage for receiving the air flow for the passage of the air into the interior of said second cartridge housing, said second cartridge housing having an oxygen-releasing chemical therein spaced upwardly from the bottom of said second cartridge housing to define an air space below the chemical, coupling means removably coupling said second cartridge housing to said first cartridge housing when said tubular connecting piece is inserted into the first receiving opening and communicating the air space below the oxygen releasing chemical in the second cartridge housing with the space below the oxygen-releasing chemical in said first cartridge housing through said second receiving opening, said tubular inlet portion having a wall disposed in said air bag, and a check valve in said wall permitting air flow from said air bag into the air flow passage of said tubular inlet portion, said second cartridge housing tubular connecting piece having a portion which is removably disposed in said tubular inlet portion of said first cartridge housing which opens at said tubular inlet portion wall with said check valve and has a top wall with an opening therethrough disposed in said air flow passage for flow from the air bag upwardly through the opening of the tubular connecting piece and through the top wall opening into the air hose and also from the air hose downwardly through the opening and through the tubular connecting piece through the second cartridge housing.

3. A respirator comprising a respirator air hose having a mouthpiece connection at one end and an opposite end, a first cartridge housing having an oxygen-releasing chemical therein, said housing having a tubular inlet portion connected between and extending transversely to said air hose and said first cartridge housing with a through flow air passage therein from said air hose to said first cartridge housing, said tubular inlet portion having a first receiving opening intermediate the air passage, said first cartridge housing having a bottom wall spaced from the oxygen-releasing chemical with an air bag opening and a second receiving opening spaced from the air bag opening, an air bag adjacent said first cartridge housing connected to said air bag opening, a second cartridge housing having one end with a laterally extending tubular connecting piece defining an air flow passage and being removably inserted into the first receiving opening of said tubular inlet portion and blocking the flow passage therethrough, said tubular connecting piece having an opening disposed in the air flow passage for receiving the air flow for the passage of the air into the interior of said second cartridge housing, said second cartridge housing having an oxygen-releasing chemical therein spaced upwardly from the bottom of said second cartridge housing to define an air space below the chemical, coupling means removably coupling said second cartridge housing to said first cartridge housing when said tubular connecting piece is inserted into the first receiving opening and communicating the air space below the oxygen-releasing chemical in the second cartridge housing with the space below the oxygen-releasing chemical in said first cartridge housing through said second receiving opening, said tubular inlet portion having a closed end wall, said second cartridge tubular connecting piece having a closed wall adjacent said closed end wall of said tubular inlet portion when said second cartridge housing is interconnected.

4. A respirator comprising a respirator air hose having a mouthpiece connection at one end and an opposite end, a first cartridge housing having an oxygen-releasing chemical therein, said housing having a tubular inlet portion connected between and extending transversely to said air hose and said first cartridge housing with a through flow air passage therein from said air hose to said first cartridge housing, said tubular inlet portion having a first receiving opening intermediate the air passage, said first cartridge housing having a bottom wall spaced from the oxygen-releasing chemical with an air bag opening and a second receiving opening spaced from the air bag opening, an air bag adjacent said first cartridge housing connected to said air bag opening, a second cartridge housing having one end with a laterally extending tubular connecting piece defining an air flow passage and being removably inserted into the first receiving opening of said tubular inlet portion and blocking the flow passage therethrough, said tubular connecting piece having an opening disposed in the air flow passage for receiving the air flow for the passage of the air into the interior of said second cartridge housing, said second cartridge housing having an oxygen-releasing chemical therein spaced upwardly from the bottom of said second cartridge housing to define an air space below the chemical, coupling means removably coupling said second cartridge housing to said first cartridge housing when said tubular connecting piece is inseted into the first receiving opening and communicating the air space below the oxygen-releasing chemical in the second cartridge housing with the space below the oxygen-releasing chemical in said first cartridge housing through said second receiving opening, said tubular inlet portion being provided with an end wall opposite to the end of said tubular connecting piece of said second cartridge housing when said second cartridge housing is connected to said first cartridge housing and being disposed in said air bag, including a check valve in said end wall of said tubular inlet portion opening inwardly to the air bag, said tubular connecting piece of said second cartridge housing having a partition wall and a second check valve in said partition wall opening into said tubular inlet portion.

* * * * *